US008536431B1

(12) United States Patent
McCabe et al.

(10) Patent No.: US 8,536,431 B1
(45) Date of Patent: Sep. 17, 2013

(54) TREMOLO

(76) Inventors: Geoffrey McCabe, Hollywood, CA (US); Gary Kahler, Oceanside, CA (US)

( * ) Notice: Subject to any disclaimer, the term of this patent is extended or adjusted under 35 U.S.C. 154(b) by 75 days.

(21) Appl. No.: 13/005,428

(22) Filed: Jan. 12, 2011

(51) Int. Cl.
*G10D 3/00* (2006.01)

(52) U.S. Cl.
USPC ..... 84/313; 84/298

(58) Field of Classification Search
USPC ..... 84/313
See application file for complete search history.

(56) References Cited

U.S. PATENT DOCUMENTS

| | | | | |
|---|---|---|---|---|
| 2,304,597 | A * | 12/1942 | Proelsdorfer | 84/297 R |
| 2,741,146 | A * | 4/1956 | Fender | 84/313 |
| 4,171,661 | A * | 10/1979 | Rose | 84/313 |
| 4,472,750 | A * | 9/1984 | Klumpp et al. | 360/78.01 |
| 4,497,236 | A * | 2/1985 | Rose | 84/298 |
| 4,724,737 | A * | 2/1988 | Fender | 84/313 |
| 5,965,831 | A * | 10/1999 | McCabe | 84/313 |
| 5,986,191 | A * | 11/1999 | McCabe | 84/313 |
| 6,175,066 | B1 * | 1/2001 | McCabe | 84/313 |
| 6,563,034 | B2 * | 5/2003 | McCabe | 84/312 R |
| 6,710,235 | B2 * | 3/2004 | Hirayama | 84/313 |
| 6,891,094 | B2 * | 5/2005 | McCabe | 84/312 R |
| 7,009,096 | B2 * | 3/2006 | Hirayama | 84/313 |
| 7,470,841 | B1 * | 12/2008 | McCabe | 84/312 R |
| 7,812,232 | B2 * | 10/2010 | Dennis | 84/299 |

* cited by examiner

*Primary Examiner* — Christopher Uhlir
(74) *Attorney, Agent, or Firm* — San Diego IP Law Group, LLC

(57) ABSTRACT

A fulcrum tremolo includes intonation modules for fine tuning or macro tuning, an unitary component forming a base plate and an adaptor plate. An improved bearing arrangement features integrated riser posts, combining the bearing axle housing with traditional riser posts, an improved bearing axle supporting bearings positioned within recesses in a bearing housing. A plain end and a threaded end of the bearing axle cooperate with a riser post having a larger plain opening and a second riser post having a threaded opening. The plain end and a ring spacer, positioned between a bearing and the second riser post, positions the bearings away from the tremolo wherein the axle is slideably positioned within the first riser post as the second end of the axle is threadedly secured to the second riser post and thereby adjustably secures the bearing arrangement relative to the body of the instrument for pivotal movement.

28 Claims, 4 Drawing Sheets

TREMOLO

BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge connected to the body. The strings are secured or fixed at one end on the body of the instrument to what is traditionally known as the tailpiece, strung over the bridge and extended past the first critical point on the nut. In conventional instruments the strings are secured beyond the nut to the tuning pegs where an untensioned string is tensioned and adjusted to a tuned condition or proper playing pitch for play; sometimes a nut arrangement for securing the strings is provided for a headless or tuning peg-less design. The tension of an individual guitar string is approximately 10 lbs at typical tuned conditions; anchoring or securely attaching the string holds the string to the instrument under normal conditions that often comprise an excess of 10 lbs of tension per string under other certain circumstances.

The second critical point can be created as a part of a combined bridge and tailpiece structure. Traditionally, the size of the bridge element is quite small so as to create a clearly defined single point of contact between the string and the bridge element. It is between these two points that the playable string length is typically determined, sometimes referred to as the scale length. Adjusting the relative distance between the first and second critical points is called harmonic tuning. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to as the "setup", it is not uncommon that further adjustment of the harmonic tuning is necessary for a variety of reasons, for example, including changing the brand of a string where the alloy of the strings is varied or when the gauge of strings the player chooses changes. The term "intonation module" refers to a device, one for each string of a stringed musical instrument, comprising a bridge element forming a second critical point adjustably positioned on the body relative to the nut or the first critical point for harmonic tuning, and one additional element, such as, for example, a tailpiece element for fixedly securing the associated string to the body, or an alternate tailpiece, or a string tuning element to pitch tune and/or adjust the tension of the associated string such as a macro-tuner or a fine-tune or parts thereof. Intonation modules can include aspects such as a base, a front end or leading edge closer to the nut, a rear edge or trailing edge further the nut, formed with recesses, restricted portions, hollow portions, etc., adjustably secured to a base plate that in some cases may comprise a tremolo in general or fulcrum tremolo in particular.

Often the typical construction of the strings, particularly for guitar and bass, includes a plain end and, on the other end, a "ball end" which being a washer-like addition is wrapped by the string itself into a larger form to help in "fixing" or securing the string on the instrument to the tailpiece. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. Stable fine adjustments of these and other elements have been a longstanding goal for stringed musical instruments.

In the relevant art, "anchoring" strings is often referred to as attaching or securing a string and understood with the limitation that the anchoring is sufficient so that the string is fixedly attached or secured to the instrument under the typical tensioned conditions of the string.

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, an interval falling between that of a whole tone and a minor third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a "vibrato" and what has come to be known as a "tremolo" sound since the 1950's. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146, shows and provides a device comprising a novel structure which incorporates the bridge and the tailpiece. The portion supporting the bridge elements is called the bridge plate or the base plate. Further, the bridge and the tailpiece connected to the base plate both move together as the fulcrum tremolo device is pivoted around a common axis transverse the direction of the strings. Accordingly, a singular and defining aspect of the fulcrum tremolo is that the harmonic tuning is upset as the device is pivoted; and, accordingly, for an instrument equipped with a fulcrum tremolo, restoring any or all of the strings to a proper pitched condition also simultaneously restores the harmonic tuning where otherwise all other conditions remain essentially the same. The base plate upon which the individual bridge elements are adjustably secured has a beveled ridge portion closest the nut which is secured to the instrument body by six screws along a common axis, or fulcrum pivot axis, permitting pivotal movement of the device which varies the tension on the strings and produces the desired tremolo effect.

In this first vintage system, herein referred to as Type I, the metal bridge elements of '146 which are stamped and folded into the suitable form are loosely held in place by a spring loaded attachment screw arrangement pivotally secured through openings in a small bent portion of the base plate farthest from the fulcrum axis. The bridge elements also incorporate setscrews for varying the relative height of the bridge elements and, therefore, height of the respective second critical points to the base plate and by extension, the body and neck. Later iterations of Fender '146 included pivotally supporting the fulcrum tremolo relative to the body by a riser posts arrangement adjustably connected to the fulcrum tremolo. Riser posts have existed since at least the 1950's and typically include an annular flange for supporting a device. The horizontal distance between the vertical centerline of each riser post is approximately 2.22". Further, the distance from the pivot point to the second critical point not including the variable heights of the bridge elements is 0.25" and the distance from the nut to the pivot is about 25.25" since the Fender Stratocaster for which this fulcrum tremolo first appeared provided a 25.5" scale length.

Typically, in order to facilitate the fulcrum tremolo pivoting about its fulcrum axis, counter springs are utilized to counteract or counter balance the pull of the strings. Counter springs are usually connected to the body of the instrument at one end and, on the other end, to a separate spring attachment means usually a block of metal, milled or cast or a combination of the two, and being secured to the bottom of the base plate by three screws 90 degrees to the base plate is often called a spring block.

One of the most profound goals with prior art has been maintaining the initial tuning at proper playing pitch. When a musician plays on the string there is usually some kind of string stretch over time that results in the overall tuning going out of balance. Specifically, when the pitch of the string changes, the position of the fulcrum tremolo and the position of the second critical point relative to the nut changes which then alters the harmonic tuning.

Initial position refers to the specific equilibrium point between the tension of the strings and the tension of the counter springs at the intended tuned pitched condition of the strings when harmonic tuning is achieved. Often the pivot means is subject to wear and the tremolo does not always return to its initial position. Great care is required to establish the initial position since both aspects of adjustment are interactive and it simultaneously provides both the proper harmonic tuning and proper pitch tuning for each of the individual strings.

Improvements to the Fender '146 Fulcrum Tremolo

Improvements to the Fender fulcrum tremolo have included using string clamps positioned both at the nut and at a point on the immediate opposite side of the intonation point or second critical point on each of the bridge elements relative to the nut in order to limit string stretch to the portion of the string within these two points defining the scale length; and, separately, adopting a novel shaped beveled edge, called a "knife edge", pivotally supported by two formed screw-like members or threaded riser posts positioned in the body to improve the return to initial position after pivoting the fulcrum tremolo device about the riser posts (Rose U.S. Pat. No. 4,171,661). The instrument body is typically provided with threaded inserts so that the riser posts, into which the riser posts are variably threaded, provide adjustable positioning of the fulcrum tremolo, and, therefore, the second critical point, relative to the instrument body and fingerboard. The knife edge fulcrum arrangement prefers the base plate to be positioned generally parallel to the instrument body to offers the novel possibility to increase the tension of the string for upward pitch changes; this feature can increase string tension well beyond the normal approximate 10 lbs of tension at typical playing pitches.

In this second vintage system, herein referred to as Type II, the horizontal distance between the vertical centerline of each riser post is approximately 2.925". The distance from the pivot point to the second critical point, not compensating for the variable heights of the bridge elements, is 0.425" and approximately 25.075" from the first critical point on the nut for instruments with a 25.5" scale length. This greater distance of 0.425" relative to Fender's 0.25" provides an additional area on the leading edge portion of the base plate, the area located closest to the nut. The Rose fulcrum tremolo assembly extra portion then includes a fork-like slot arrangement extending between the bridge portion and the leading edge of the base plate. An attachment screw is positioned within the fork-like slot for threadedly securing the Rose improvement to the base plate. Accordingly, sliding the fork-like portion and, therefore, the Rose assembly in the direction of the string adjusts the harmonic tuning of the string.

In Rose U.S. Pat. No. 4,497,236 a combination of the bridge element, the tailpiece and fine tuners replaced the "novel structure" of the Fender device so that within the limited range (typically within a range about the interval of a whole tone, for example from C to D in the Western diatonic musical scale) the strings could be re-tuned without first unlocking the string clamps at the nut. However, string stretch beyond the range of the fine tuners necessitated a correction that is tedious and time consuming involving unlocking the string clamps, re-tuning the strings, re-clamping, and further re-tuning the string with the fine tuners and then re-tuning all the other strings to re-balance the equilibrium point back to initial position. The string clamps of the Rose fulcrum tremolo are characterized by small blocks slideably mounted within a recess within a housing element connected to the bridge element. The player typically cuts the ball-end of the string off and then vertically places the cut end of the string within the recess between the block and a vertical surface located closest to the bridge element created by the recess and then bends in the direction of the tuning pegs—there are later designs that do not require the ball end to be cut off for the clamping mechanism to fixedly secure a string.

Each block is adjustably secured by an adjustment bolt aligned in the direction of the strings—threading the adjustment bolt slideably positions the block against the plain string end and clamps the string end between the block and a vertical surface of the recess in housing element. A first portion is formed parallel the instrument body that is the functional equivalent of the base plate of Fender '146 for securing the bridge elements. Adjustment bolts, one for each block, extend through slots formed in a second portion of the base plate fashioned to be simultaneously rising away from the body and nut at approximately a 45 degree angle. The second portion includes fine tuner screws threadably positioned transverse the direction of the strings that make variable contact with the adjustment bolt. Threading the fine tuner screw collectively pivots the position of the block and the housing element connected to the bridge portion as well as the bridge portion and the adjustment bolt about a separate axis parallel to the fulcrum axis for fine tuning the tension of the string.

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

Both the bridge portions and the string anchoring means, the tailpiece, simultaneously move about a fulcrum axis;

The harmonic tuning is upset; and

Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning.

For those fulcrum tremolos fitted with string clamps at the first and second critical points as in Rose U.S. Pat. No. 4,171,661, String stretch beyond the clamps at the first and second critical points is eliminated offering the most stability of tuning possible;

A plain end of the string is inserted between the bock and a vertical surface formed in a recess in the housing element and clamped by threading an adjustment bolt; the adjustment screw is pivotally positioned in the direction of the strings and the fine tuner adjustment screw is both transverse to the adjustment bolt and direction of the strings.

These two vintage fulcrum tremolos of the last century, Fender in the 50's and Rose in the 80's, are in part distinguished by the differing standards in the spacing between the riser posts, 2.22" and 2.925" respectively; and the relative distance between the riser posts and the first critical point on nut on the one side, 25.25" and 25.075", respectively, and, from an overview perspective, 0.25" and 0.425", respectively, from the pivot point to the second critical point on the bridge on the other.

The individual parts of the two vintage designs were generally not compatible. Consequently, those who had guitars with the 2.925" spacing were limited to tremolos that had fine tuner arrangements and string locks and those guitars with the 2.22" spacing were limited to those tremolos without fine-tuners and string locks.

Further Improvements

Further improvements in the fulcrum tremolo in the 90's and into the new millennium utilize various novel arrangements for pivotally supporting the fulcrum tremolo so that the base plate can be variably spaced from the surface of the body. Using bearing devices that include riser posts and at least a portion of the surface of a ball bearing or the like at the pivot point adjustably mounted to the body could encompass a range of bearing devices including self-aligning bearing arrangements affording a universal joint type movement to typical ball bearings and, as such, the bearing arrangements, thereby, not only provided greater adjustment for installations but substantially improved return to initial position after use of the tremolo while virtually eliminated the wear and tear associated with knife-edge and other related prior art (McCabe U.S. Pat. Nos. 5,965,831, 5,986,191, 6,175,066, 6,563,034, 6,891,094 and 7,470,841).

The preferred bearing arrangement of '066, '831 and '094 which share the same parent application showed bearing devices supported on pins or shafts positioned between each of two fork-like portions formed in the base plate. The bearing devices are positioned within a bearing housing that received threaded riser posts for adjustably securing the fulcrum tremolo to the instrument body.

The preferred bearing arrangement of '191 and '841 showed bearing devices supported on pins or shafts extending outwardly, each from the sides of the base plate, and positioned within a bearing housing that received threaded riser posts for adjustably securing the fulcrum tremolo.

A preferred bearing arrangement of '034 and '841 showed bearing devices supported on a single bearing axle or shaft located at the edge of the base plate closest the nut within a tube-like housing connected to housings for receiving the bearing devices. The bearing axle is received by a bearing axle housing connected to threaded riser posts for adjustably securing the bearing arrangement and, thereby, the tremolo.

Other improvements to bearing arrangements for fulcrum tremolos found expression in Hirayama U.S. Pat. No. 6,710,235 showing an electric guitar having a first critical point on the neck or nut and a second critical point defined to be on the tremolo base plate further pivotally secured to a body. In this patent the bearing arrangement includes a "hinge mechanism" for "supporting the base plate such that the base plate pivots relative to the body". Plain openings in the sides of the base plate, on the opposite side of the riser post vertical axis from the nut, each receive a pair of bearing devices supported by support pins or riser posts each variably positioned in the body on each side of the base plate and connected to a pair of brackets, each with bracket pins. Each riser post corresponds to one of the bearing devices and is located closer to the neck than the corresponding bearing device. "Each bracket is coupled to one of the support pins. Each bracket pin is coupled to one of the brackets and fits into the corresponding bearing device." The bracket pins create the pivot axis. Accordingly, since the pivot axis for the fulcrum tremolo is created by the bearing devices, the axis is on the opposite side of the riser posts relative to the nut by approximately 0.375" and creates a "feel" or resistance when pivoting the tremolo with the arm that is other than the "feel" of those designs deploying bearings placed on the centerline of the riser posts which is otherwise very close to where the traditional pivot is created. Misalignments of the bracket pins can cause binding in the bearings and defeat the primary goal of successfully returning the fulcrum tremolo to the initial position.

A critical relationship exists between the bearing housing, bearing axle, bearing axle housing and the riser posts since the introduction of play between any of these elements created by variations in tolerances can cause unwanted distortions in the overall geometry that otherwise require expensive solutions associated with higher materials requirements and tolerances.

The evolution from fine tuners to macro-tuners on a fulcrum tremolo (McCabe U.S. Pat. Nos. 5,965,831, 5,986,191, 6,175,066, 6,563,034, 6,891,094 and 7,470,841) provides a self-contained intonation module that includes a novel modular integrated bridge-tailpiece structure, adjustably secured to the base plate of a fulcrum tremolo for achieving harmonic tuning, wherein the improvement includes either an alternative tailpiece or, in various iterations, the broad provision, located on the opposite side of the bridge element from the nut, a macro-tuner to bring and adjust the strings to playing pitch from an untensioned condition circumventing the re-tuning limits imposed by the Rose style clamps/fine tuner arrangement and other limited range tuners.

Additionally, various forms of novelty are provided for limiting the stretch of the string between the second critical point and the tailpiece portion and, thereby, render inextensible while allowing an adjustment knob to be threaded to achieve macro tuning '094 presents a novel quick two-step macro tuner designed to bring each string to proper playing pitch in a first step and then further tuned by a separate fine tuner knob. Other intonation modules were simple and offered an alternative tailpiece function to the traditional Fender position at the end of the spring block.

Macro-tuners refer to tuners with the capacity to raise and adjust the tension of the strings from an untensioned condition to a proper playing pitch, and as such provide for alternate tunings and compensation for substantial string stretch during the life of the string essentially without additional means.

Other improvements as disclosed in McCabe '831, '066, '094 and 191 included "tiers" or "steps" positioned on the base plate of the fulcrum tremolo, one for each bridge element or intonation module, that in displacing their relative positions create a radius for the strings in relationship to the radius of the fingerboard.

McCabe '841 and '191 provide a global tuning mechanism on the fulcrum tremolo that compensates for the problems associated with varying humidity on the instrument as well as other factors that could affect the instrument's geometry. Further, a "global tuner", in a preferred embodiment includes a thumbwheel portion and provides a simple and quick means for the musician to adjust the initial position of the fulcrum tremolo in order to meet the pitch requirements in varied situations. Further, the "global tuner", in re-establishing the initial position, allows the full range of pivoting the fulcrum tremolo.

"Global tuners" refer to a device added to a fulcrum tremolo with the capacity to adjust the equilibrium point between tension of the counter spring(s) and the tension of the strings in order to compensate for changes in tension requirements on the strings and/or the counter springs. The global tuner preferably employs an adjustment knob or thumb wheel for providing continuously variable adjustment of the tension in the strings by varying the relative distance between the spring attachment portion connected to the base plate of the fulcrum tremolo and the attachment point of the springs to the body of the instrument.

McCabe '034 discloses a modular fulcrum tremolo system with standardized base plate features available in both the vintage 2.925" and 2.22" riser post dimensions where all the parts other than the base plate, such as the intonation modules solid, formed or folded, bent, with or with out fine tuners or macro-tuners, the global tuners, the tremolo arm assembly, etc. are interchangeable. Consequently, any guitar or bass, for example, can have simple intonation modules or macro-tuners regardless of the insert spacing present on the instrument.

McCabe '841 and '034 provide an unitary base plate formed, in one instance, from a single folded or bent plate including a spring attachment means portion so that the tremolo is connected directly to the biasing springs typically connected to the body; such a bent construction comprises a first portion that also includes multiple tiers for variably displacing the height of the second critical point on the intonation modules relative to the body and fingerboard of the instrument and a spring attachment portion, fashioned perpendicular to the first portion, such that the openings for anchoring the ends of the strings or a first anchoring portion are aligned to openings in the base plate for threading the strings through the intonation modules. The second portion can also include further articulations in the form to provide for adding, among other options a global tuner.

Other features included bending a first portion of the unitary component comprising the base plate into a one-piece hinge-like form closest to the bearing axis creating a housing for receiving the bearing devices or bearings and/or the shaft for pivotally supporting the bearing assembly. Optionally, a cylinder or tube for receiving the bearings or bearing devices can be fashioned for the same purpose and welded, for example, to the base plate in the same position. And in either case the dimensions of this portion reflects the spacing differences between the two vintage standards. Features also included "coining" a radius into the base plate, for example, in a series of steps or tiers to account for the radius of the fingerboard and eliminating the requirement of individual bridge element height adjustment screws so that the entirety of the bridge elements rest on the base plate maximizing acoustic coupling. "Coining" refers to that process in the stamping of metal that provides for a "relief" in the "landscape" of the object being formed.

Further, prior collaborative efforts with Gary Kahler and Geoffrey McCabe, U.S. application Ser. No. 12/686,968, for example, provide for an improved modular lever-based "string through" fine-tuner arrangement for a fulcrum tremolo, that allows a string to be threaded within a pivoting elongated member forming a tailpiece for stringing the instrument that eliminates the requirement found in the Rose-based designs of cutting the ball-end off the string as well as, in another example, an inclusion of an multi-function adaptor plate that can added to the unitary component, for example, to support fine tuners.

Advantageous acoustic or vibrational characteristics often suggest reduction in the number of parts in any one device since an increased number of parts tends to, otherwise, create an acoustic sponge-like response where otherwise a simpler execution provides a more direct "coupling" and, thereby, a more pure and vibrant response to more transparently support the acoustic tone.

SUMMARY OF THE INVENTION

Accordingly, the primary object of this invention is to provide improvements to the bearing arrangement element comprising at least a portion of a ball bearing surface or the like for forming the pivot axis on a tremolo device including but not limited to the fulcrum tremolo wherein at least two of a group comprising various bearing arrangement elements, such as the bearing housings, riser posts, bearing axle, axle housings, bearing devices themselves and spacers, are physically integrated.

Improved Bearing Arrangement

A primary improvement to the bearing arrangement is the integrated riser post, provided by, in one instance, physically integrating or physically combining the bearing axle housing with the riser posts. The integrated riser posts, at least, by reducing the part number of the bearing arrangement element in general, provide for an improved acoustic coupling of the tremolo to the instrument body offering the player an instrument capable of a greater range of expression. Alternately, a bearing housing could be integrated into the riser post, for example, or the above integrated riser posts could further comprise spacers into more refined singular units.

While in one embodiment the bearing element, bearings or bearing devices, comprising at least a portion of a ball bearing or like surface, are spatially positioned, in some cases by separate bearing spacers, within a bearing housing connected to the base plate, the preferred embodiment positions a set, a pair of ball bearings, for example, in recesses in each end of the bearing housing.

In the preferred embodiment an improved bearing axle extends through the bearings in the bearing housing supported on each end by an integrated riser post to receive an improved bearing axle. The bearing housing, the improved bearing axle and the improved riser posts are essentially centered on and aligned to the fulcrum axis. Threadably adjusting such riser posts secures the bearing axle, the bearing axle housing, the bearing element and the fulcrum tremolo, and therefore, the second critical point, relative to the instrument body.

The improved bearing axle of the preferred embodiment is formed with a first plain end and a second threaded end, each with an approximate length equal to the diameter of the integrated riser post, wherein the first plain end has a larger diameter than the rest of the bearing axle and the diameter of the threaded end is equal to or less than the general diameter of the bearing axle; and accordingly, a first riser post has a larger plain opening or smooth bore for receiving the larger first or plain end of the bearing axle and a second riser post has a threaded opening for receiving the threaded second end of the bearing axle are provided wherein the first end of the axle is slideably positioned within the first riser post and the second end of the axle is threadedly secured to the second riser post.

Further, in the preferred embodiment, ball bearing races are provided and the specific diameter of the plain end, while typically the same dimension as the outer diameter of the inner ring, must be less than the inner diameter of the bearing outer ring so as to ensure the plain end, while making bearing contact with the inner ring of the bearing, does not engage the bearing in a way that would bind with the bearing or inhibit the free rotation of the fulcrum tremolo about the pivot axis.

The second riser post threaded portion also provides a recess portion connected to a ring spacer placed around the improved bearing axle for spacing the bearings relative to the first riser post and the fulcrum tremolo base plate when the bearing axle is threaded into position. In a further preferred embodiment the second riser post has another recess portion formed to receive the ring spacer on other side of the threaded bore. A further embodiment comprises an additional extended ring or tube that makes contact with the inner rings of the innermost bearings of each set for securing and establishing the position of each bearing or bearing set relative to each other.

In practice, the installation of the bearing arrangement follows the initial threaded positioning of the riser posts within the inserts in the body to establish the center line of the axis of the bearing axle as pivot axis and, thereby, the position of the second critical point relative to the body. The bearing sets are installed in each end of the bearing tube and collectively positioned between the two riser posts.

The threaded end of the bearing axel is inserted though the plain end of the first riser post and pushed through the first set of the bearings, passing through the second set of the bearings at the other end. A ring spacer is then positioned over the threaded end of the bearing axle before making threaded contact with threaded portion of the second riser post. Threading the axle into the threaded portion of the second riser post, secures the ring spacer between with the inner ring of the outside bearing of the related bearing set and within the recess formed in the second riser post near the threaded portion, and positions the larger plain end of the bearing axle against the inner ring of the outside bearing of the other bearing set to variably secure the bearing arrangement connecting the fulcrum tremolo pivotally to the instrument body. Thus, the plain end is slideably positioned within the first riser post to adapt to distortions in the dimensions of the stud spacings, traditionally, either 2.22" or 2.925", for example, as the axle is threadedly located into the preferred position to secure the bearing assembly and provide the fulcrum axis.

DETAILED DESCRIPTION OF THE INVENTION

Figure 1:
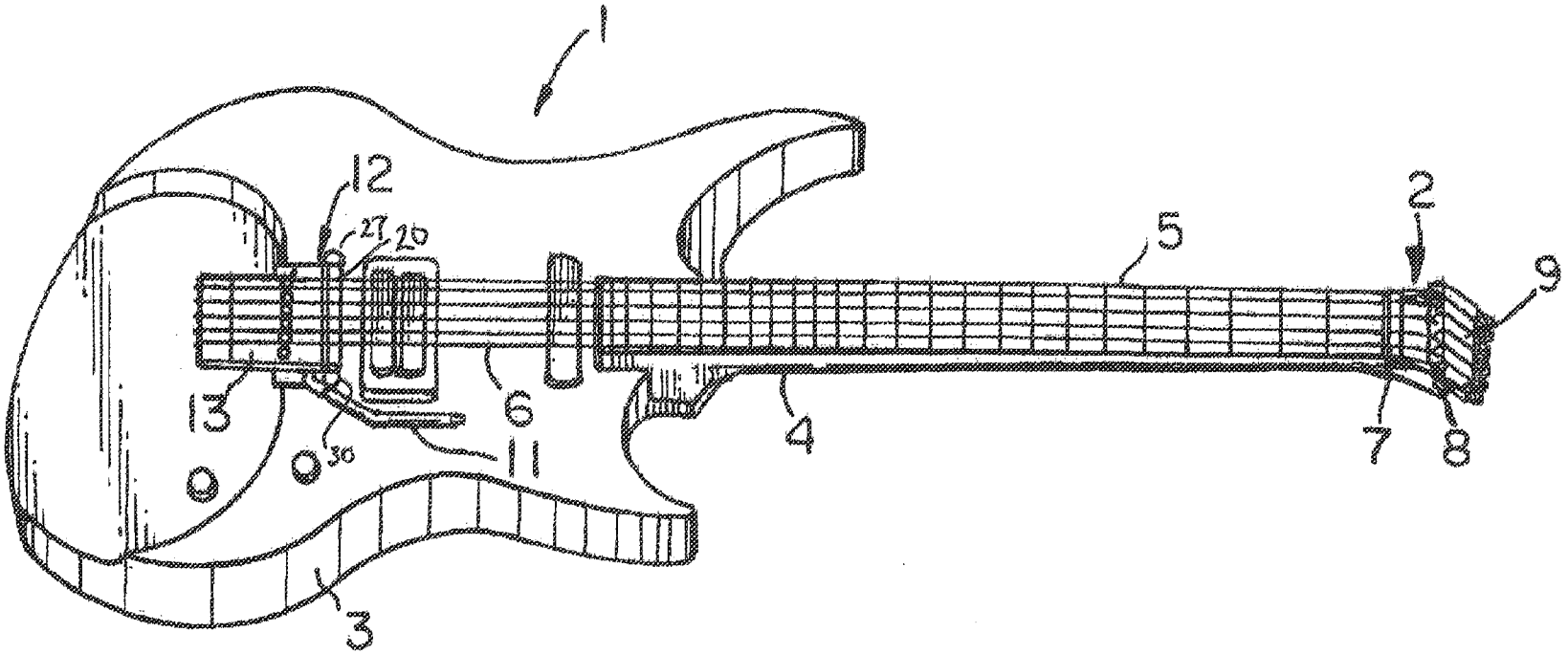
FIG. 1 is a plan view of an electric guitar embodying the present invention.

In FIG. 1, an electric guitar 1 is illustrated comprising a head 2 at one end, a body 3 at the other end, with a neck 4 extending between head 2 and body 3. Six strings 6 extend from head 2 to body 3 over neck 4. Neck 4 forms fret board or fingerboard 5 for guitar 1. At head 2, each string 6 extends over nut 7 forming first critical point 8 for each of strings 6. Nut 7 is located at the transition of neck 4 to head 2. Each string 6 is secured on head 2 by a corresponding tuner 9. On the body 3, strings 6 are secured to fulcrum tremolo 10. Fulcrum tremolo 10 has arm 11 for pivoting tremolo 10 and providing the vibrato effect on strings 6. Fulcrum tremolo 10 has six of intonation module 12, one for each string 6.

The present invention of the improved bearing arrangement is shown with tube-like bearing housing 20 and integrated riser posts 27 and 30 on fulcrum tremolo 10 having intonation modules 15 which can incorporate fine tuners or macro tuners comprising the function of the bridge element and tailpiece in its structure as well as the capacity to adjustably fix one end of the individual strings to the instrument at an alternate tailpiece position. Each intonation module 15 is slideably secured to the base plate to adjust the relative distance between first critical point 8 and second critical point 16 or the harmonic tuning as such.

The invention is shown for us on electric guitar 1 and it should be understood that the invention could be used on a variety of stringed musical instruments.

In body 3 of guitar 1 there are electric pickups shown without numbers.

In the following description, fulcrum tremolo 10 will be described in greater detail. Fulcrum tremolo 10 comprises includes second critical point 14, one for each of strings 6, sometimes characterized as an intonation point, witness point or bridge point.

Figure 2:
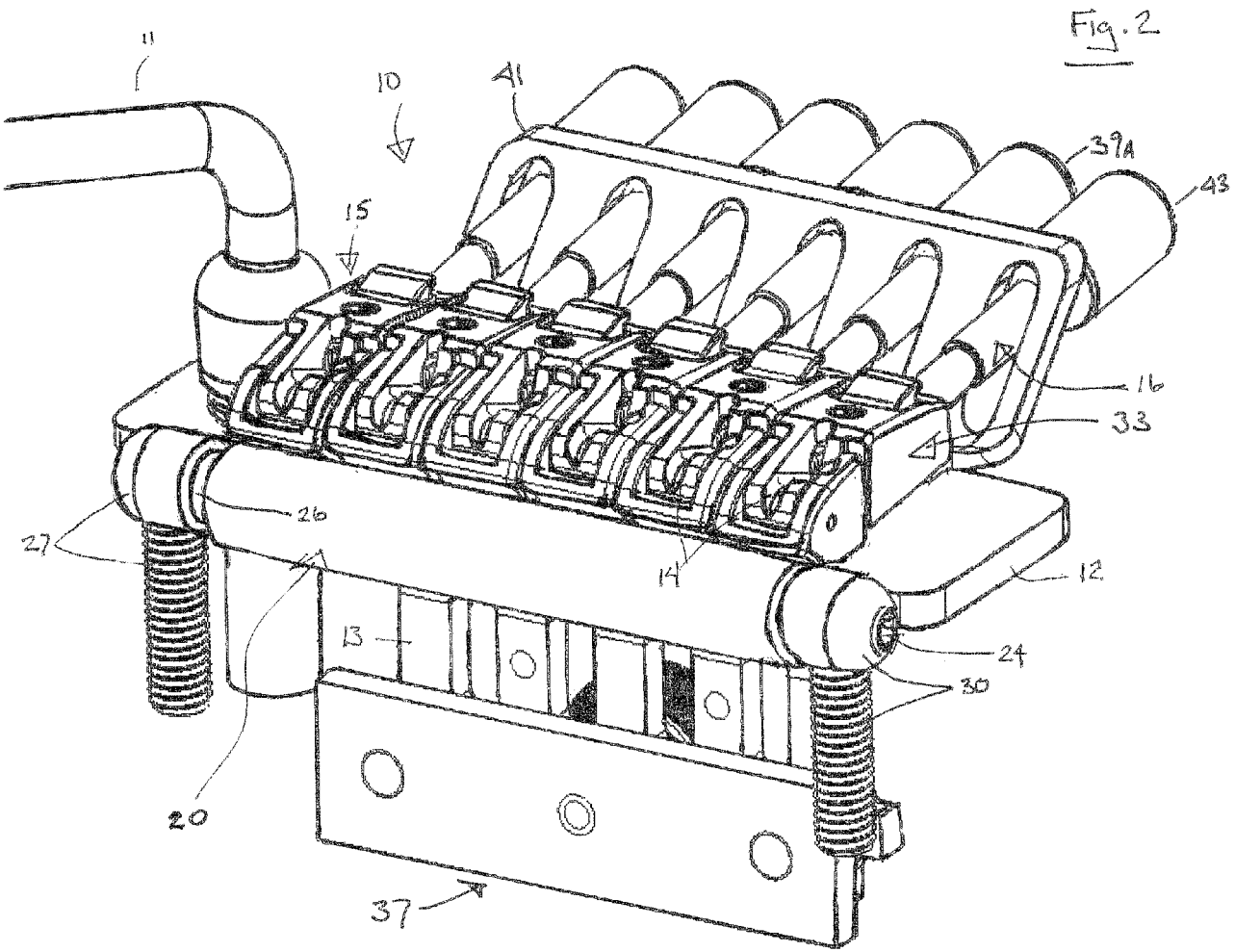
FIG. 2 is a front ¾ perspective view of the improved bearing arrangement of the present invention for providing the pivot of a fulcrum tremolo employing both the pivoting lever-based fine tuners, a global tuner arrangement and the unitary component base plate and an adaptor plate associated with the fine tuners.

FIG. 2 shows improved fulcrum tremolo 10 comprising base plate 12 further comprising unitary component 13, six of intonation module 15 extending in the direction of string 6, each having fine tuner arrangement 33 comprising second critical point 14, pivoting elongated member 16 further comprising tailpiece 43 (not shown), fine tuner adjustment knob 39*a*, adaptor plate 41 connected to base plate 12 and the improved bearing arrangement.

The bearing arrangement shown in an assembled form further comprises tube-like bearing housing 20, bearing elements 22*a* (and 22*b*—visible in FIGS. 3 & 4) and integrated riser posts 27 and 30 include bearing axle housing portions 29 (as well as 31 and 32 shown in FIG. 3) and threaded portions 28 connected to an articulated bearing axle 23 shown in part by enlarged first plain end 24. Bearing elements 22, bearing axle 23, and bearing housing 20 and, therefore, base plate 12 and the rest of the fulcrum tremolo apparati are adjustably supported for pivotal movement relative to body 3. Integrated riser posts 27 and 30 comprise threaded portions 28 connected to body 3 insert 36. Threading integrated riser posts 27 and 30 into insert 36 variably positions portions of the bearing arrangement and, thereby, fulcrum tremolo 10 to body 3 for pivotal displacement.

By manipulating tremolo arm 11, the entire fulcrum tremolo 10 can be pivoted about bearing axle 23 to achieve the desired tremolo effect.

Figure 3:
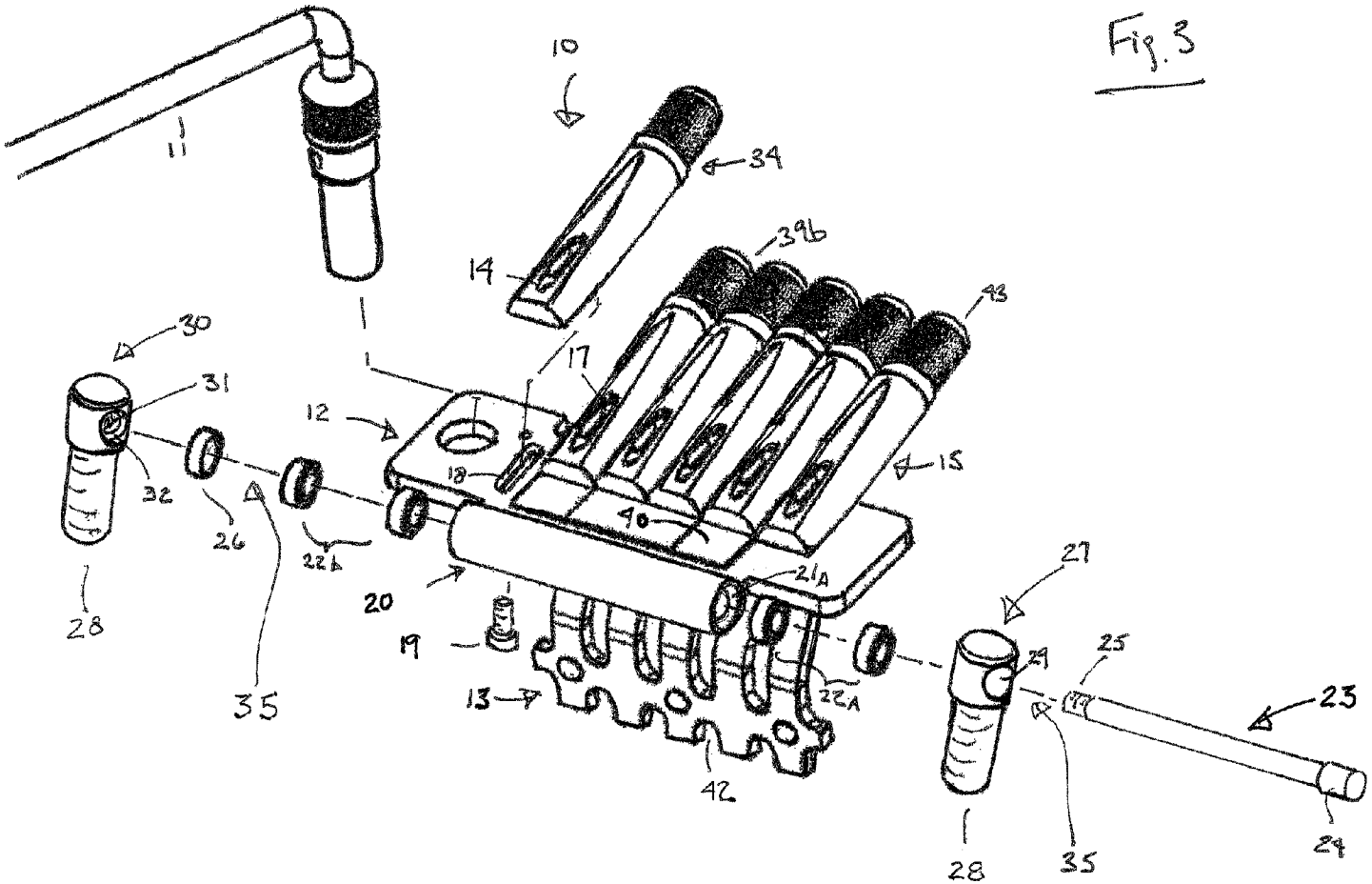
FIG. 3 is a front ¾ perspective "exploded" view of the improved bearing arrangement of the present invention for providing the pivot of a fulcrum tremolo employing slidable elongated member-based macro tuners intonation modules similar to those shown in '191 and '841 and an unitary component base plate arrangement including tiers and string anchor points as well as the intonation slot and attachment screw arrangement to variably tune the harmonic tuning of the second critical point on an intonation module relative to the first critical point.

FIG. 3 shows an "exploded view" of fulcrum tremolo 10 comprising base plate 12 further comprising unitary component 13 with intonation slots 18 for receiving attachment screw 19 threadedly connected to intonation module 15 and tiers 40. Intonation module 25 provides second critical point 14 on macro tuner 33 comprising slideable elongated member 17 (shown in part) providing tailpiece 43 (not shown), macro tuner adjustment knob 39*b*, global tuner 37 and the improved bearing arrangement.

The bearing arrangement comprises tube-like bearing housing 20 further comprising recesses 21*a* (and 21*b*—not shown) in each end of bearing housing 20 to receive corresponding bearing elements 22*a* and 22*b*. Integrated riser post 27 is shown with threaded portion 28 and smooth bore portion 29. Integrated riser post 30 is shown with threaded portion 28 and threaded opening portion 31 further comprising spacer recess 32 for receiving ring spacer 26.

Bearing axle 23 further comprises first plain end 24 corresponding to smooth bore portion 29 having a diameter generally larger than the rest of bearing axle 23 to limit movement of bearing element 22*a* along the length of the bearing axle in one direction and to limit contact between bearing element 22*a* and integrated riser post 27 in the other direction; second threaded end 25 corresponding to threaded opening portion 31 has a diameter equal to or less than the diameter of the bearing axle and each bearing axle portion 24 and 25 having a length substantial enough to secure bearing axle 23 firmly and variably to the integrated riser posts 27 and 30.

First riser post 27 plain opening or smooth bore portion 29 is formed to receive larger first plain end 24 and second riser post 30 has threaded opening portion 31 for receiving the second threaded end 25 wherein the first end 24 is slideably positioned within first riser post 27 when the second threaded end 25 is threadedly secured to second riser post 30 to adjustably position bearing axel 20 relative to integrated riser posts 27 and 30 and, thereby, address minor distortions in the distance between the riser post center lines for individual instruments.

Further, in the preferred embodiment, ball bearing elements 22*a* and 22*b* comprising a set of two bearings elements each further comprising an inner and an outer ring; the specific diameter of plain end 24, while typically the same dimension as the outer diameter of the inner ring, must be less than the inner diameter of the outer ring so as to ensure plain end, 24 while making variable contact with the inner ring, does not engage any portion of bearing 22*a* in a way that would bind with or inhibit the free rotation of fulcrum tremolo 10 about the pivot axis 35.

Riser post 30 includes inner restricted portion 32 for receiving ring spacer 26 comprising an inner diameter to permit installation about bearing axle 23 and an outer diameter less than the inner dimension of the outer ring of bearing 22*b* and, in the preferred embodiment, similar to the outer diameter of first end 24 limit contact between bearing element 22*b* and integrated riser post 30.

Figure 4:
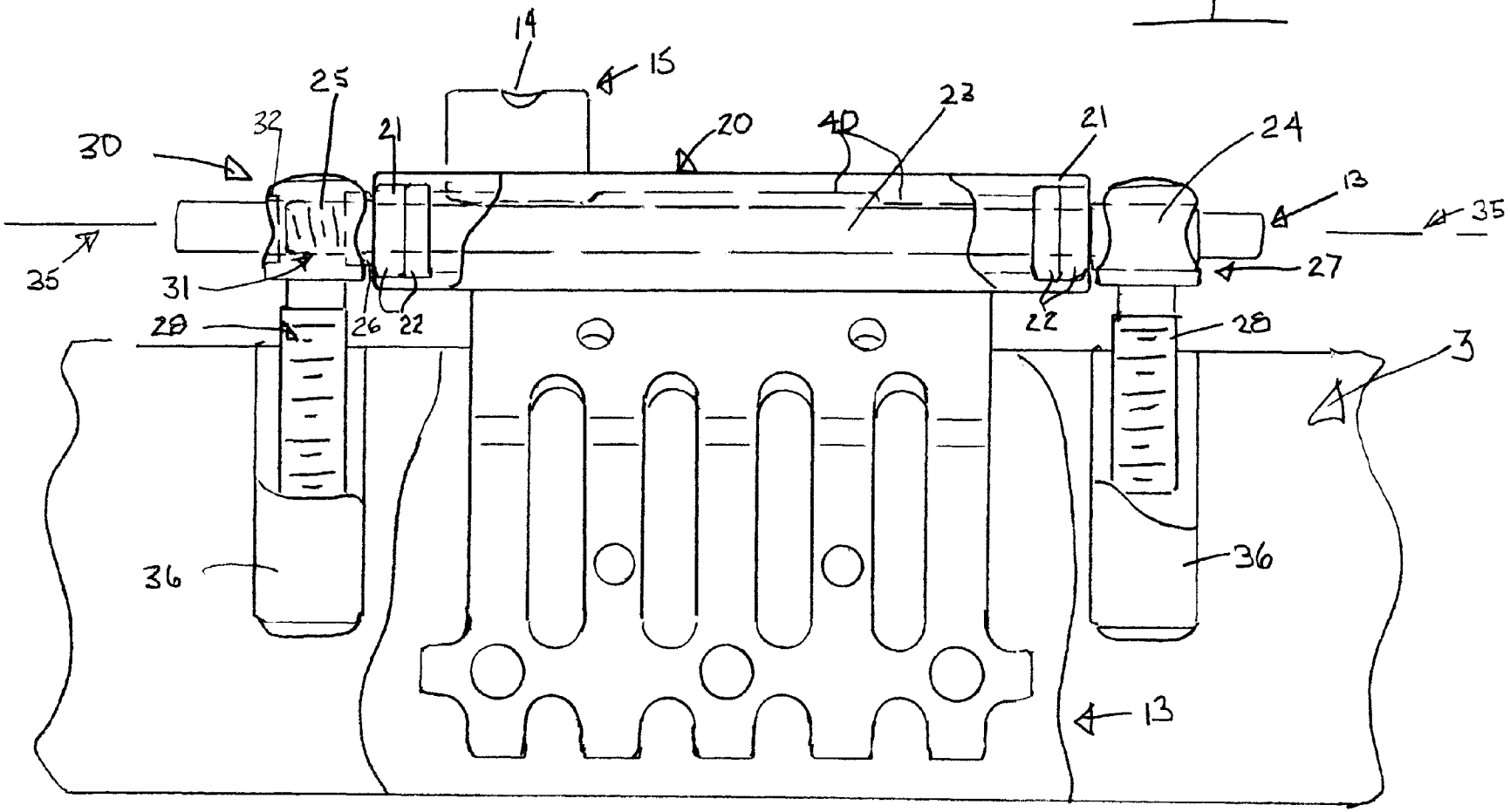
FIG. 4 is a front view of fulcrum tremolo 10 with partial cross-section of the improved bearing arrangement providing the pivot axis that includes intonation modules or simple bridge elements supported on base plate tiers comprising the unitary component providing alternative tailpiece portion 43.

FIG. 4 is a front partial cross-section view of the improved bearing arrangement connected to base plate 13 further comprising unitary component 13 with tiers 40 for variably supporting intonation module 14 (only one is shown) comprising second critical point 14 further connected to inserts 36 positioned in body 3.

In practice, the installation of the bearing arrangement follows the initial threaded positioning of the integrated riser posts 27 and 30 within inserts 36 in body 3 to establish the center line axis of bearing axle 20 as pivot axis 35 and, thereby, the position of second critical point 14 relative to body 3. Bearing element sets 22*a* and 22*b* are installed in corresponding recesses 21*a* and 22*b* in each end of bearing housing 20 and collectively positioned between integrated riser posts 27 and 30.

Bearing axle 23 second threaded end 25 is then extended first through riser post 27 smooth bore portion 29 for pivotally supporting bearing elements 22*a* and 22*b* in bearing housing 20, then ring spacer 26 and finally makes threaded contact with riser post 30 threaded opening portion 31. Further treading end 25 within riser post 30 both secures spacer ring 26 between bearing 22*b* and riser post 30, variably positions first end 24 within smooth bore portion 29 and against the inner ring of bearing element 22*a* to space bearing element 22*a* away from riser post 27 to adjustably secure the bearing arrangement and, thereby, fulcrum tremolo 10 to body 3.

The various features of novelty which characterize the invention are intended to contribute to the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

We claim:

1. An apparatus for a stringed musical instrument, the stringed musical instrument comprising a body, a neck extending outwardly from the body, a plurality of strings extending in a direction from the body to the neck, a nut to form a first critical point for each of the strings, a fulcrum tremolo pivotally mounted on the body, the fulcrum tremolo comprising: a pivot axis, a plurality of intonation modules comprising a base plate, and a bearing arrangement to pivotally support the fulcrum tremolo on the pivot axis transverse to the direction of the strings comprising at least one bearing element connected to the base plate, the apparatus comprising:

a plurality of bearing arrangement elements comprising:

at least one bearing axle element having an axis transverse the direction of the plurality of strings, at least one riser post to further adjustably mount the fulcrum tremolo relative to the body, the at least one riser post further comprising a first threaded portion having a riser post axis extending generally perpendicular to the body, at least one bearing housing element for receiving at least one bearing element having an axis transverse the direction of the plurality of strings extending from the body to the neck, and at least one bearing axle housing element having an axis transverse the direction of the plurality of strings, the at least one bearing axel housing formed for receiving at least one bearing axle element, and wherein one of the plurality of bearing arrangement elements comprises at least one integrated riser post combining at least one riser post and at least one bearing axle housing element, wherein the at least one integrated riser post comprises a first integrated riser post associated with a first end of the bearing housing element and a second integrated riser post associated with a second end of the bearing housing element, wherein the first integrated riser post comprises a smooth bore opening portion having an axis generally aligned to at least one bearing axle element axis and the second integrated riser post comprises a threaded opening portion having an axis aligned to at least one bearing axle element axis.

2. The apparatus of claim 1 further comprising at least one spacer element for positioning at least one bearing element relative to the base plate.

3. The apparatus of claim 1 further comprising at least one spacer element for positioning at least one bearing element relative to at least one integrated riser post.

4. The apparatus of claim 3, wherein the at least one spacer element further comprises at least one ring spacer positioned between at least one bearing element and at least one integrated riser post.

5. The apparatus of claim 1, wherein the at least one integrated riser post further combines at least one spacer element.

6. The apparatus claim 4 wherein the at least one bearing housing element comprises a single tube-like form having an axis transverse the direction of the strings further comprising a first end and a second end of the tube-like form.

7. The apparatus claim 6 wherein the at least one bearing housing element comprises a recess in each the first end and the second end to receive the at least one bearing element.

8. The apparatus of claim 1 wherein the at least one bearing axle element has a first smooth end associated with the first integrated riser post and a second threaded end associated with the second integrated riser post aligned to the pivot axis.

9. The apparatus of claim 8 wherein the at least one bearing element comprises a first bearing associated with a first end of the bearing housing element having an inner ring and outer ring and a second bearing associated with the second bearing housing element having an inner ring and outer ring.

10. The apparatus of claim 9 wherein the first end of the bearing housing element has a diameter larger than an inner dimension of the inner ring of the first bearing and the second end has a diameter less than an inner dimension of the inner ring of the second bearing and an overall length generally equal to or greater than a distance between the first and second integrated riser posts.

11. The apparatus of claim 10 wherein the distance between the first and second riser post axis is approximately 2.22".

12. The apparatus of claim 10 wherein the distance between the first and second riser post axis is approximately 2.925".

13. The apparatus of claim 10 wherein a common axis of the first end, the second end, the smooth bore opening portion, the threaded opening portion, the first bearing, the second bearing and the bearing housing element is the pivot axis of the fulcrum tremolo wherein threading the bearing axle element second threaded end into the threaded opening portion positions:

the first smooth end to make variable contact within the first riser post smooth bore opening portion and variable contact against the inner ring of the first bearing to position first integrated riser post away from the first bearing, and the at least one ring spacer between the inner ring of the second bearing to position the second integrated riser post away from second bearing and the second integrated riser post to secure an assembly of the bearing arrangement elements and to permit pivotal displacement of the fulcrum tremolo relative to the body.

14. The apparatus of claim 1, wherein each intonation module further comprises an elongated element located on an opposite side of bridge element from the nut and in variable relation to the second critical point operable to tension a string.

15. The apparatus of claim 14, wherein the elongated element is variable contact with a threaded adjustment knob.

16. The apparatus of claim 14, wherein the elongated element comprises a fine tuner.

17. The apparatus of claim 14, wherein the elongated element comprises a macro-tuner.

18. The apparatus of claim 16, wherein the elongated element comprises a pivoting lever portion comprising a tailpiece element.

19. The apparatus of claim 17, wherein the elongated element comprises a pivoting lever portion comprising a tailpiece element.

20. The apparatus of claim 17, wherein the elongated element comprises a slideable portion comprising a tailpiece element.

21. The apparatus of claim 1, wherein the base plate further comprises a unitary component.

22. An apparatus for a stringed musical instrument, the stringed musical instrument comprising a body and a neck, a plurality of strings extending from the body to the neck, a nut for supporting the strings on the neck forming a first critical point for each string and a bridge element connected to the body forming a second critical point for each string and supporting the strings on the body, the apparatus comprising:

a tremolo element having a pivot axis positioned on an opposite side of the bridge element from the nut having a bearing arrangement to pivotally support the tremolo element on the pivot axis, the bearing arrangement further comprises:

a tailpiece element connected to the tremolo element for receiving and securing the strings to the instrument body, at least one bearing element to pivotally support the tremolo element on the pivot axis connected to the apparatus, bearing arrangement elements comprising:

at least one attachment element to adjustably mount the tremolo to the body comprising a first threaded portion, at least one bearing housing element for receiving at least one bearing element having an axis transverse a direction of the plurality of strings, at least one bearing axle element having an axis transverse the direction of the plurality of strings, and at least one bearing axle housing element having an axis transverse the direction of the plurality of strings for receiving at least one bearing axle element, wherein the at least one attachment element comprises at least one riser post for adjustably positioning the tremolo relative to the body, the bearing arrangement elements comprises at least one integrated riser post combining at least one riser post and at least one bearing axle housing element, a first bearing housing element and a second bearing housing element each formed with recesses to receive at least one bearing element, the at least one integrated riser post comprises a first integrated riser post associated with the first bearing housing element and a second integrated riser post associated with the second bearing housing element, and the first integrated riser post includes a smooth bore opening portion having an axis aligned to the pivot axis and the second integrated riser post includes a threaded opening portion having an axis aligned to the pivot axis.

23. The apparatus of claim 22 wherein the at least one bearing axle has a first smooth end associated with the smooth bore opening portion of the first integrated riser post and a second threaded end associated with the threaded opening portion of the second integrated riser post and comprises a pivot axis.

24. The apparatus of claim 23 wherein the at least one bearing element comprises a first bearing associated with the first bearing housing element having an inner ring and outer ring and a second bearing associated with the second bearing housing element having an inner ring and outer ring.

25. The apparatus of claim 24 wherein the first smooth end has a diameter larger than an inner dimension of an inner ring of the first bearing and the second threaded end has a diameter less than a dimension of the inner ring of the second bearing and an overall length generally corresponding to a distance between the first and second integrated riser post axis.

26. The apparatus of claim 25 wherein an axis of each the first smooth end, the second threaded end, the smooth bore opening, the threaded opening, the first bearing, the second bearing and the at least one bearing housing element comprise the pivot axis of the tremolo wherein threading the second threaded end into the threaded opening positions:

the first smooth end to make variable contact within the first riser post smooth bore opening portion and variable contact against the inner ring of the first bearing to position first integrated riser post away from the first bearing, and the at least one ring spacer between the inner ring of the second bearing to position the second integrated riser post away from second bearing and the second integrated riser post to secure an assembly of the bearing arrangement elements and to permit pivotal displacement of the tremolo relative to the body.

27. The apparatus of claim 26 wherein the at least one bearing housing element comprising a first bearing housing element and a second bearing housing element each formed with recesses to receive at least one bearing element and further comprises a single tube-like form having an axis aligned to the pivot axis.

28. The apparatus of claim 27 wherein the tremolo is a fulcrum tremolo.

* * * * *